United States Patent [19]

Gutterman

[11] 4,282,817

[45] Aug. 11, 1981

[54] EXPANDABLE FURNITURE

[76] Inventor: Gary Gutterman, 160 E. 56th St., New York, N.Y. 10022

[21] Appl. No.: 43,312

[22] Filed: May 29, 1979

[51] Int. Cl.[3] ..... A47B 83/00; A47C 17/66

[52] U.S. Cl. ..... 108/11; 108/63

[58] Field of Search ..... 108/11, 17, 63, 64, 108/65, 69, 77, 150

[56] References Cited

U.S. PATENT DOCUMENTS

| | | | |
|---|---|---|---|
| 1,618,523 | 2/1927 | Feldman et al. | 108/63 |
| 1,735,535 | 11/1929 | Feldman | 108/63 |
| 2,110,068 | 3/1938 | Kowalski | 108/11 |
| 2,545,891 | 3/1951 | Mehr et al. | 108/11 X |
| 2,680,661 | 6/1954 | Bremer | 108/63 |
| 2,852,325 | 9/1958 | Fosnaugh | 108/63 |

FOREIGN PATENT DOCUMENTS

| | | | |
|---|---|---|---|
| 1803546 | 11/1967 | Fed. Rep. of Germany | 108/11 |

*Primary Examiner*—Roy D. Frazier
*Assistant Examiner*—Peter A. Aschenbrenner
*Attorney, Agent, or Firm*—Peter L. Berger

[57] ABSTRACT

An article of furniture forming a cube when side table height and comprising hingedly connected side and top members and a pedestal which lifts to enable said cube to open to form a large size dinner table. The top can also be opened when at side table height.

9 Claims, 10 Drawing Figures

FIG.1
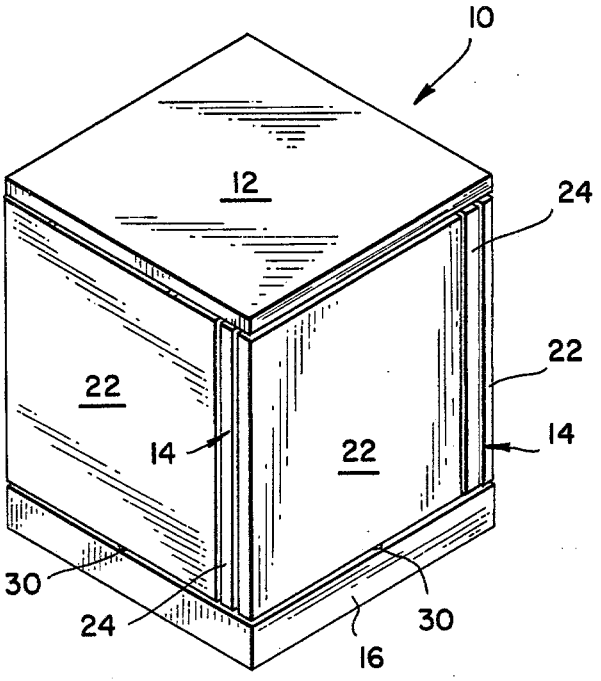
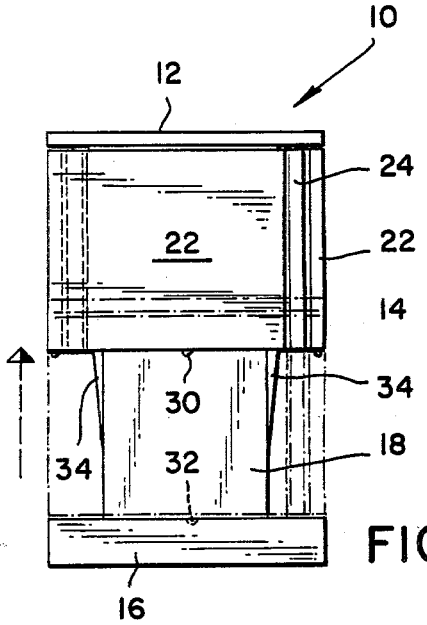
FIG.2
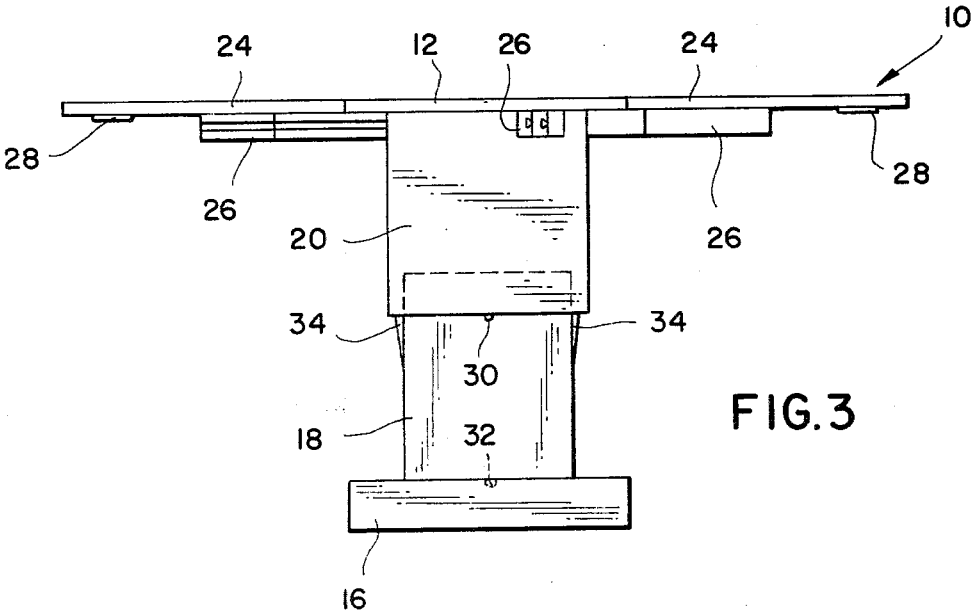
FIG.3

FIG.6
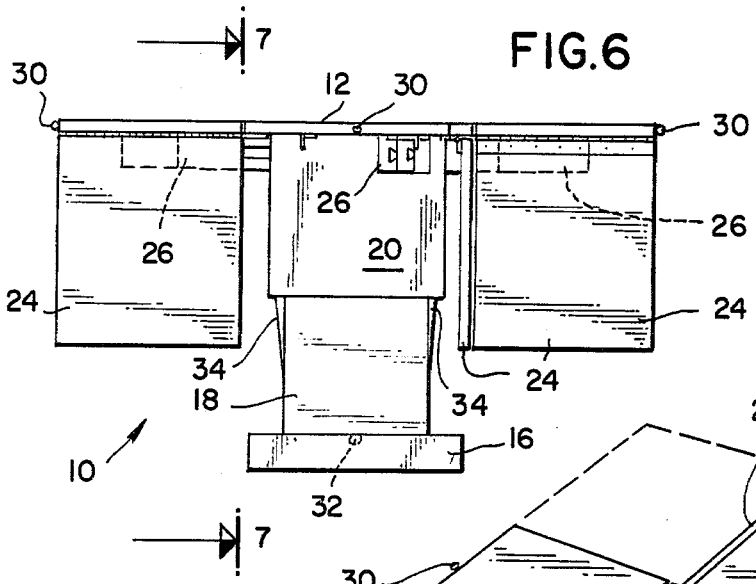
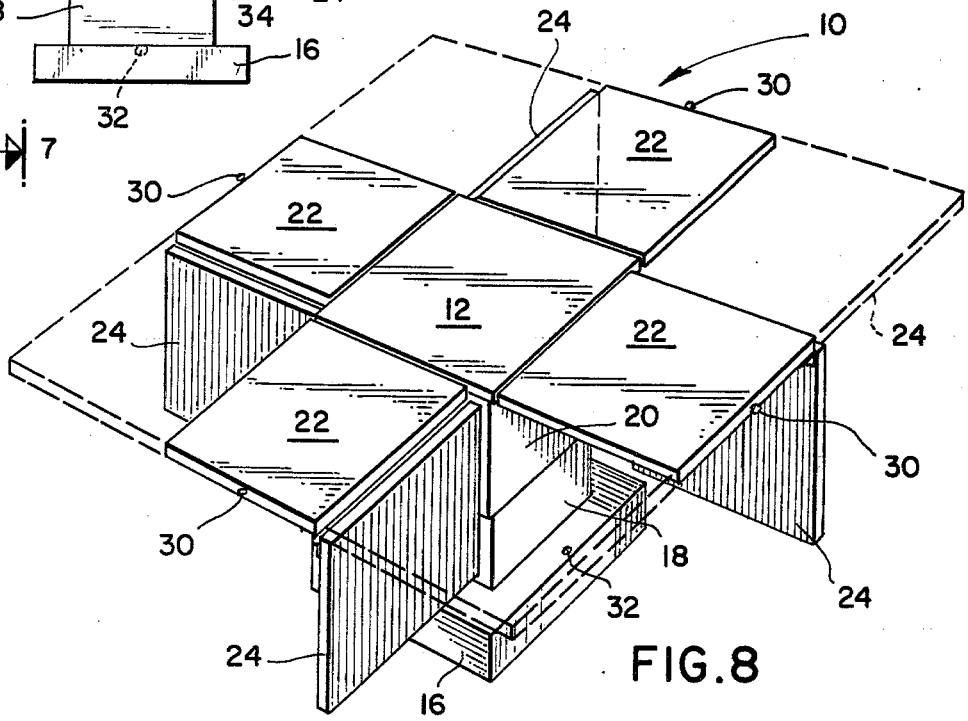
FIG.8
FIG.7
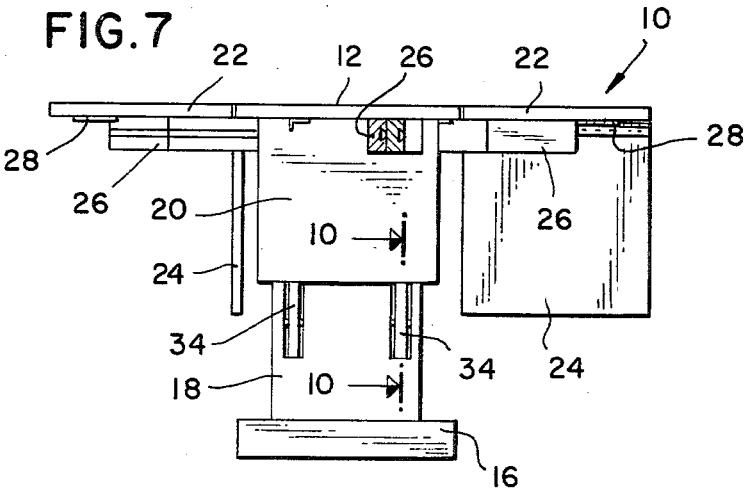

FIG.9
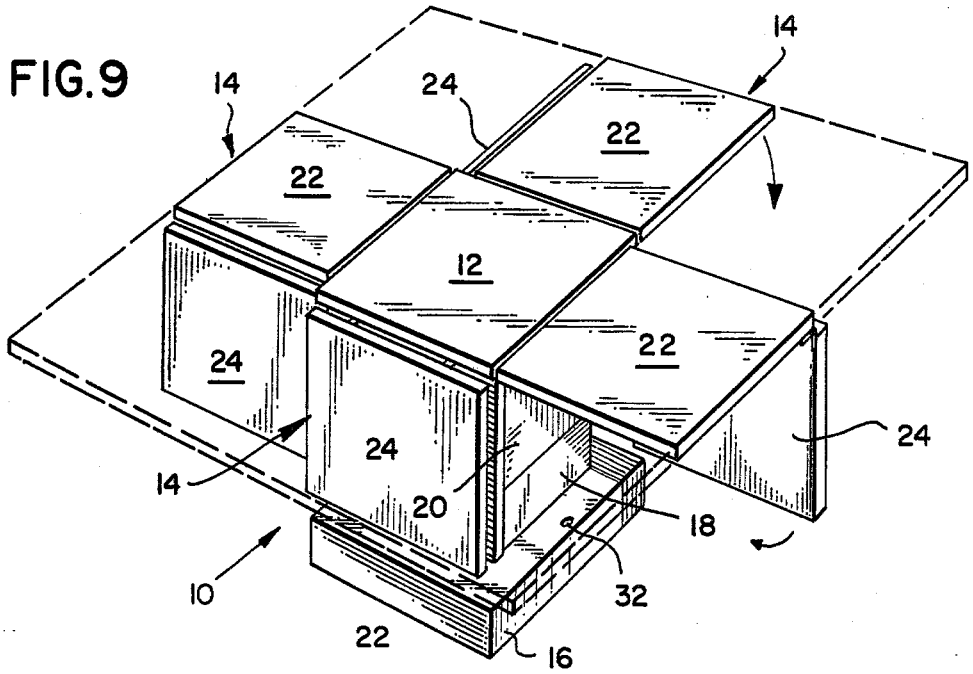
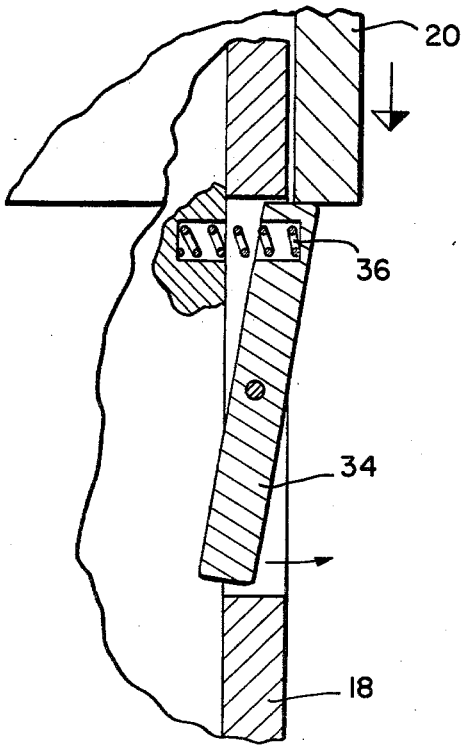
FIG.10

EXPANDABLE FURNITURE

BACKGROUND OF THE INVENTION

This invention relates to an article of furniture which is capable of being opened to a size much larger than that which is presented when in its closed position.

Space is increasingly a premium in many urban areas, and especially in apartments. With the ever diminishing small apartment sizes, multiple purpose furniture is finding increasing demand.

Frequently, urban apartment dwellers need to have large dining tables for dinner parties, but such tables cannot be maintained in open positions, because of space limitations. As a consequence, many unique unusual and original arrangements are created by such apartment dwellers to produce dining tables without their being permanently opened.

Such prior art attempts to provide this type of expandable table include unwieldy complex and difficult mechanisms and apparatus. Further, frequently these devices require disassembly and storage of the parts in closets or other out of the way places. Other arrangements have been proposed in which tables are hingedly connected to walls, so that they may fold down when not in use to conserve space. Such an arrangement limits the seating area around the table, since one side is substantially attached to the wall.

An object of this invention is to provide a unique and improved expandable article of furniture which can open to a dining table yet be stored in a small compact and efficient form.

Another object of this invention is to provide such an article of furniture which serves a multiplicity of purposes, such as a side table when in a closed position and a dining table when in an open position.

Another object of this invention is to provide such an article of furniture which may be easily utilized, simple to manufacture, and susceptible of being sold at relatively reasonable costs.

Yet another object of this invention is to provide such an article of furniture in which the expandable members are hingedly connected together so that no part is separated from the main body, and easy opening and closing is achieved without separating elements therefrom.

Other objects and advantages and features of this invention will become more apparent from the following description.

SUMMARY OF THE INVENTION

In accordance with the principles of this invention, an article of furniture is disclosed in which an original cube shape of side table height is presented, the cube shaping formed of panels which are hingedly connected together so as to open to form a table top, with a pedestal having an expandable assembly enabling the top of the table to be lifted to dining table height. The cube has a top which forms a central top section for the dining table, and side panels are hingedly connected to the top which are capable of being opened and expanded to form a large substantially square table. The side panels are retained in downward vertical position to form closed sides for the cube which is formed when at side table height, and suitable support members are provided for supporting the side panels when swung to their horizontal position to form the dining table top. The top may be opened when at side table height.

BRIEF DESCRIPTION OF THE DRAWINGS

FIG. 1 is a perspective view of the article furniture of my invention which is in a closed position forming a cube side table.

FIG. 2 is a side view of the cube being raised to table height.

FIG. 3 is a side elevation view showing the table fully opened at dining table height.

FIG. 6 is a side view taken along the lines 6—6 of FIG. 5 showing a side extensions in their down position.

FIG. 7 is a cross-sectional view taken along the lines 7—7 of FIG. 6.

FIG. 8 is a perspective view of the dining table in its upper position with the side extensions in their down position.

FIG. 9 is a perspective view similar to FIG. 8 showing the side panels being folded down with the side extensions folded under the outer side panels.

FIG. 10 is a detailed view of the pedestal locking member showing the mechanism for locking the cube in its upper dining table height position.

DETAILED DESCRIPTION OF THE INVENTION

Figure 4:
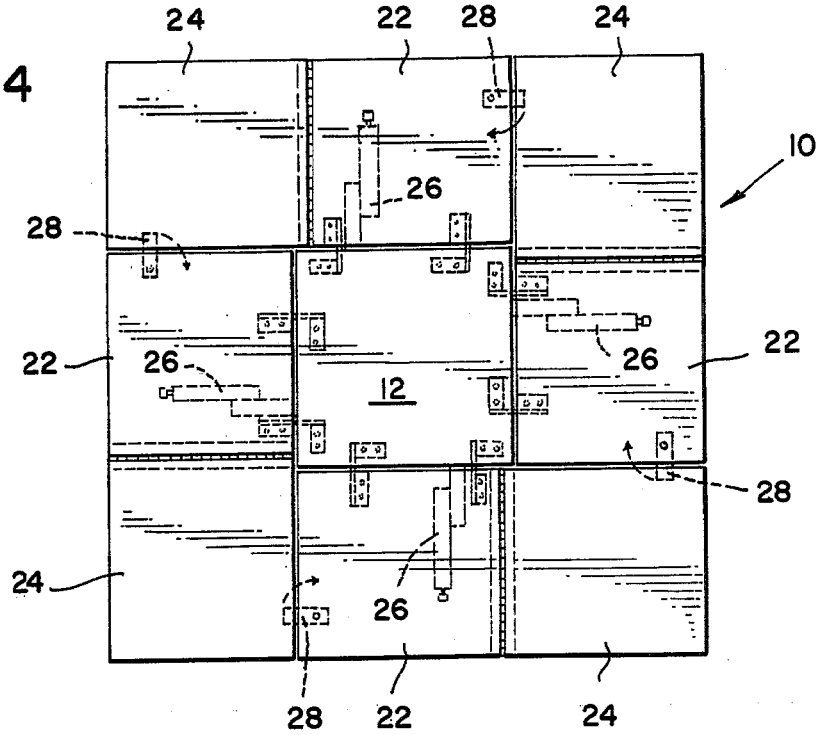
FIG. 4 is a top plan view showing the table fully opened at dining table height.
Figure 5:
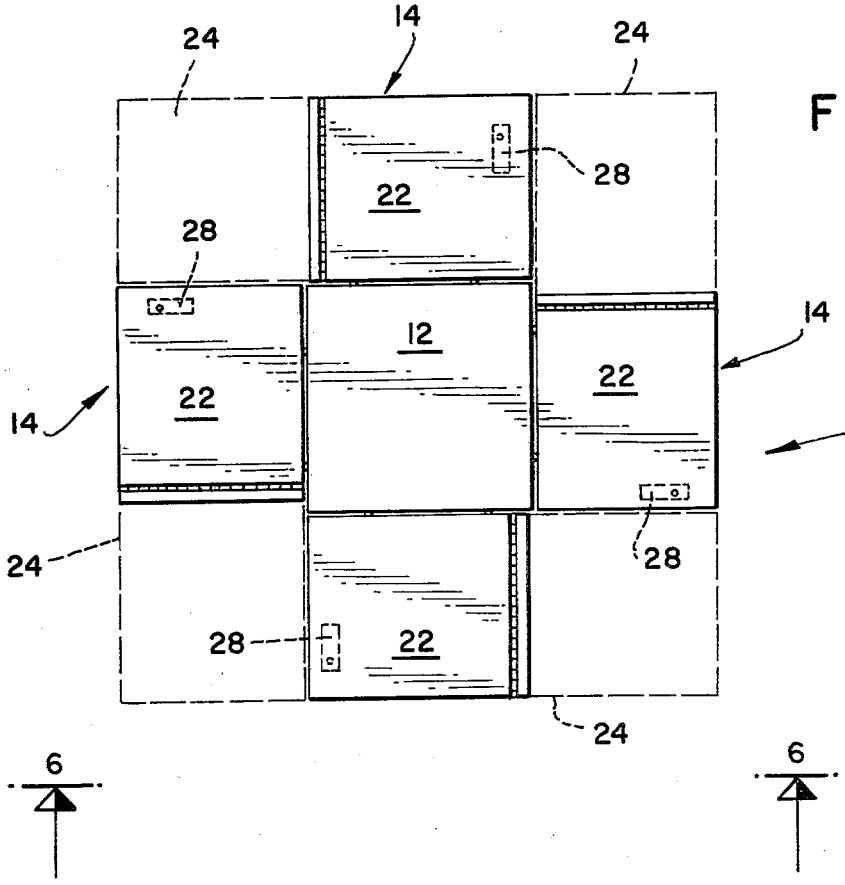
FIG. 5 is a top view similar to FIG. 4 with a side extension member of each side panel in a down position.

Referring now to the drawings, there is shown in FIG. 1 a perspective view of my invention which comprises an article of furniture having a generally cubular shape 10. The cubular shape article of furniture is of substantially side table height and comprises a top central portion 12 and a plurality of side panels 14, the side panels forming closed sides for the cube 10. A bottom base is located below the bottom side panels 14 and the base 16 has substantially the same straight sides as does top central portion 12. In this fashion, side panels 14 fits between top central portion 12 and base 16 when the cubular article of furniture is formed, as in FIG. 1.

FIG. 2 is a side view illustrating the operation of an inner pedestal 18 which includes an operative mechanism to move the upper portion 20 of the cube 10 from side table height as in FIG. 1 to dining table height as in FIG. 2. When moved to its upper position, upper section 20 is locked in place and held at the dining table height. In FIG. 2, base 16 is more clearly seen and is connected to pedestal 18 to provide a floor support for the pedestal and table 10. As seen in FIG. 2, top central portion 12 is somewhat longer than the width of panel 14, and the additional overhang allows the thickness of the sides of the members forming panel 14 to be accommodated under the top central portion so as to enable the closed cube construction 10 of FIG. 1 to be ensured.

FIGS. 8 and 9 illustrate the article of furniture being opened to form a dining table. In particular, each side panel 14 is formed of two separate members, one being a side member 22 which is hingedly connected at the straight side of the center top section 12 and an extension member 24 hingedly connected to side member 22.

Referring to FIG. 4, each such side member 22 is opened to a horizontal position, and a concealed support bracket 26 (see FIGS. 3 and 7) is slid out from pedestal 18 to support side member 22 in its horizontal position. As illustrated in FIG. 4, each such side panel is supported by a respective supporting bracket 26 so that all four side panels are extended in their horizontal positions, after each side panel has been moved from its vertical position which form the cube.

After each side member 22 is firmly in place, each corresponding extension member 24 is moved from the vertical position to a horizontal position so as to close the square table (see FIGS. 4, 5, 8 and 9). A slidable support tab 28 is located at the side edge of each side member 22, and tab 28 is adapted to support adjoining extension member 24 in the horizontal position to form said dining table top. As illustrated in FIGS. 8 and 9, each extension member 24 is lifted from the vertical to the horizontal position so as to form the substantially square dining table.

The top may be expanded when at the lower side table height, and the amount of expansion of the table top can be selected to utilize any number of panels and/or side extensions.

When the side panels are in their vertical position, a male locking button member 30 located on the edge of each respective side member 22 cooperates with a female locking member 32 located on base 16 to close the side panels to the vertical position sandwiching extension member 24 between side member 22 and pedestal 18 to form the closed cube configuration of FIG. 1.

When the table is to be brought back to its original cube shape, the side extension members 24 are first folded down as in FIG. 9, and then each side extension member 24 is folded under side member 22 to form a closed side panel 14 which is firmly locked in place due to the cooperation of locking members 30 and 32.

FIG. 10 shows a detail of a locking member locking the table in its upper dining table height position. In particular, a pivotable support member 34 is held in its vertical position when upper section 20 is in the down position, but when raised to its upper position, a spring 36 urges the support member 34 to swivel so that a fixed support is provided under upper section 20 as it rises above the top of support 34 enabling support 34 to be moved outwardly under force of said spring 36. When it is desired to close the table, the support 34 is merely pushed back against the spring pressure, and upper section 20 is dropped thereby trapping the support in its unblocked position.

As may be readily understood, the present invention provides a unique and novel article of furniture which is stored as attractive cube side table, yet is opened to form a dining table of substantially large dimension than the small cube side table. In fact, the table top formed by the article of furniture has an area which can be as large as approximately 9 times the area formed by the central portion 12. This is because each of the portions of the top and side panels of the cube combine to form the top of the table surrounding the top central portion in the manner described above. Additionally, the top may be expanded to provide a cocktail table when the lower height of the cube is employed.

Other modifications and changes will be apparent to persons skilled in the art to provide the above-described invention while still embracing the teachings of this invention.

I claim:

1. An article of furniture comprising a pedestal and a table top, said table top including a central top portion, said pedestal comprising an expandable assembly to enable said top selectively to be at side table height and to be raised to be at dinner table height, said central top portion having straight sides, a panel extending from each of said sides and being hingedly connected thereto, each of said panels including a side member and an extension member, said extension member hingedly connected to said side member, said extension member being folded under said side member, each of said panels being folded down about its respective hinge connection to sandwich said extension member between said pedestal and said side member to form a cubular configuration when all of said panels are so folded down.

2. An article of furniture as claimed in claim 1, wherein said central top portion is square and said panels form square side panels, whereby a closed cube is formed when said pedestal base is at side table height and said panels are dropped to a vertical position.

3. An article of furniture as claimed in claim 2, wherein each of said panels forms a closed side panel of said closed cube and said central top portion forms the top of the cube.

4. An article of furniture as claimed in claim 2, wherein each of said panels comprises retaining means operable to retain said panel in said vertical position.

5. An article of furniture as claimed in claim 1, wherein said pedestal comprises a base, a central expandable assembly connected between said base and said top, said base having straight sides matching the straight sides of said central top portion, said panels fitting between said central top portion and said base when in said vertical position to form said cubular configuration.

6. An article of furniture as claimed in claim 5, wherein each of said panels comprises a male locking member, said base comprising a female locking member on each side to cooperate with a respective one of said male locking members to lock said panel in said vertical position.

7. An article of furniture as claimed in claim 1, wherein said pedestal comprises support bracket members slidable concealed within said pedestal, said support bracket members comprising slide means to slide said support bracket members out from said pedestal to support said panel when said panel is hingedly swung to a horizontal position to maintain said panel in said horizontal position.

8. An article of furniture as claimed in claim 7, wherein each of said extension members initially hangs in a vertical position when said panel is moved to said horizontal position, said support member being slideable under said side member of said panel to support each of said side members of said panel while said extension member hangs vertically from respective side members, each of said extension members being moved into a horizontal position to form the fully opened table top, each of said side members comprising support means for supporting an adjacent extension member.

9. An article of furniture as claimed in claim 8, wherein said support means of said side member comprises a tab movable to extend from the edge of said side member to support said extension member.

* * * * *